US008121527B2

(12) United States Patent
Oyama et al.

(10) Patent No.: US 8,121,527 B2
(45) Date of Patent: Feb. 21, 2012

(54) IMAGE FORMING APPARATUS HAVING A NEUTRALIZING MEMBER OF DETERMINED RESISTIVITY

(75) Inventors: Hajime Oyama, Kanagawa (JP); Katsuhiro Echigo, Saitama (JP); Takahiro Tamiya, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 875 days.

(21) Appl. No.: 12/034,275

(22) Filed: Feb. 20, 2008

(65) Prior Publication Data

US 2008/0213010 A1 Sep. 4, 2008

(30) Foreign Application Priority Data

Feb. 21, 2007 (JP) ..... 2007-041358

(51) Int. Cl.
*G03G 15/20* (2006.01)

(52) U.S. Cl. ..... 399/313

(58) Field of Classification Search ..... 399/66, 399/302, 308, 313, 297
See application file for complete search history.

(56) References Cited

U.S. PATENT DOCUMENTS

| | | | | |
|---|---|---|---|---|
| 5,233,395 | A * | 8/1993 | Kohyama | 399/314 |
| 5,983,060 | A * | 11/1999 | Namekata et al. | 399/297 |
| 6,173,148 | B1 * | 1/2001 | Matsuda et al. | 399/310 |
| 2006/0209151 | A1 * | 9/2006 | Tamiya et al. | 347/103 |
| 2007/0092300 | A1 * | 4/2007 | Aruga et al. | 399/239 |
| 2007/0217832 | A1 | 9/2007 | Oyama et al. | |
| 2007/0286636 | A1 * | 12/2007 | Inada et al. | 399/101 |

FOREIGN PATENT DOCUMENTS

| | | |
|---|---|---|
| JP | 2000-298408 | 10/2000 |
| JP | 3514191 | 1/2004 |
| JP | 2004-227016 | 8/2004 |
| JP | 2004-287383 | 10/2004 |
| JP | 2005-99181 | 4/2005 |
| JP | 2006-301577 | 11/2006 |
| JP | 2007-171784 | 7/2007 |
| JP | 2007-241164 | 9/2007 |
| JP | 2007-322515 | 12/2007 |

* cited by examiner

*Primary Examiner* — David Gray
*Assistant Examiner* — Billy J Lactaoen
(74) *Attorney, Agent, or Firm* — Oblon, Spivak, McClelland. Maier & Neustadt, L.L.P.

(57) ABSTRACT

An exit blade is arranged on a downstream side of a transfer nip formed between a photosensitive element and a primary transfer roller, with an intermediate transfer belt being put therebetween, and brought into contact with an internal surface of the intermediate transfer belt. A neutralizing bias of the same polarity as that of the toner is applied to the exit blade, rather than a primary transfer bias voltage.

19 Claims, 6 Drawing Sheets

IMAGE FORMING APPARATUS HAVING A NEUTRALIZING MEMBER OF DETERMINED RESISTIVITY

CROSS-REFERENCE TO RELATED APPLICATIONS

The present application claims priority to and incorporates by reference the entire contents of Japanese priority document 2007-041358 filed in Japan on Feb. 21, 2007.

BACKGROUND OF THE INVENTION

1. Field of the Invention

The present invention relates to a color image forming method using a transfer belt and a bias apparatus in secondary transfer of an image forming apparatus, in electrophotography, electrostatic recording, electrostatic printing, and the like.

2. Description of the Related Art

In electrophotographic image forming apparatuses, when a toner image is transferred onto a recording medium directly or indirectly from an image carrier, on which the toner image has been formed, toner scattering (hereinafter, "dust") can occur. Particularly, dust is likely to be generated in a gap on an immediately downstream side of a primary transfer nip.

This problem occurs due to discharge generated in the gap when the recording medium is moved from a nip to the gap. Conventionally, a unit that positively reduces the discharge has not been provided (see, for example, Japanese Patent Application Laid-open No. 2000-298408 and Japanese Patent Application Laid-open No. 2004-287383).

There has been a proposal in which a conductive brush applied with a bias of a reverse polarity to a charge of an intermediate transfer belt is brought into contact with a rear face of the intermediate belt at a position on the downstream side of the nip (see, for example, Japanese Patent Application Laid-open No. 2004-227016)). In this proposal, however, if there is nonuniformity in a neutralizing effect by the conductive brush member, discharge occurs on an entrance side of the nip in a transfer unit for the next color, and dust of the toner image is easily generated.

SUMMARY OF THE INVENTION

It is an object of the present invention to at least partially solve the problems in the conventional technology.

According to an aspect of the present invention, there is provided an image forming apparatus including an image carrier on which a toner image is formed; a transfer belt that is an endless belt member having either one of a single-layer structure and a multilayer structure, the transfer belt forming a transfer nip by abutting against the image carrier while being supported by a plurality of supporting members to make an endless movement; a transfer bias member that applies a transfer bias to the transfer belt, while abutting against an internal surface of the transfer belt at a position of the transfer nip; and a neutralizing member that applies a voltage of same polarity as that of a toner or an electric current of same polarity as that of the toner to the transfer belt. A first end of the neutralizing member is fixed to a main unit of the image forming apparatus, and a second end of the neutralizing member makes a contact with the internal surface of the transfer belt. At least a surface layer or a sub-layer of the neutralizing member having a contact with the transfer belt is made of a material having volume resistivity higher than one tenth of volume resistivity of a member forming the internal surface of the transfer belt.

Furthermore, according to another aspect of the present invention, there is provided an image forming apparatus including an image carrier on which a toner image is formed; a transfer belt that is an endless belt member, forming a transfer nip by abutting against the image carrier while being supported by a plurality of supporting members to make an endless movement; a transfer bias member that applies a transfer bias to the transfer belt, while abutting against an internal surface of the transfer belt at a position of the transfer nip; and a neutralizing member that applies a voltage of same polarity as that of a toner or an electric current of same polarity as that of the toner to the transfer belt. A first end of the neutralizing member is fixed to a main unit of the image forming apparatus, and a second end of the neutralizing member makes a contact with the internal surface of the transfer belt. At least a surface layer or a sub-layer of the neutralizing member having a contact with the transfer belt is made of a material having volume resistivity higher than that of a member forming the transfer bias member.

Moreover, according to still another aspect of the present invention, there is provided an image forming apparatus including an image carrier on which a toner image is formed; a transfer belt that is an endless belt member, forming a transfer nip by abutting against the image carrier while being supported by a plurality of supporting members to make an endless movement; a transfer bias member that applies a transfer bias to the transfer belt, while abutting against an internal surface of the transfer belt at a position of the transfer nip; and a neutralizing member that applies a voltage of same polarity as that of a toner or an electric current of same polarity as that of the toner to the transfer belt. A first end of the neutralizing member is fixed to a main unit of the image forming apparatus, and a second end of the neutralizing member makes a contact with the internal surface of the transfer belt. At least a surface layer of a portion of the neutralizing member making a contact with the transfer belt is made of a material having surface resistivity higher than that of a member forming the internal surface of the transfer belt.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained in detail below with reference to the accompanying drawings.

Figure 1:
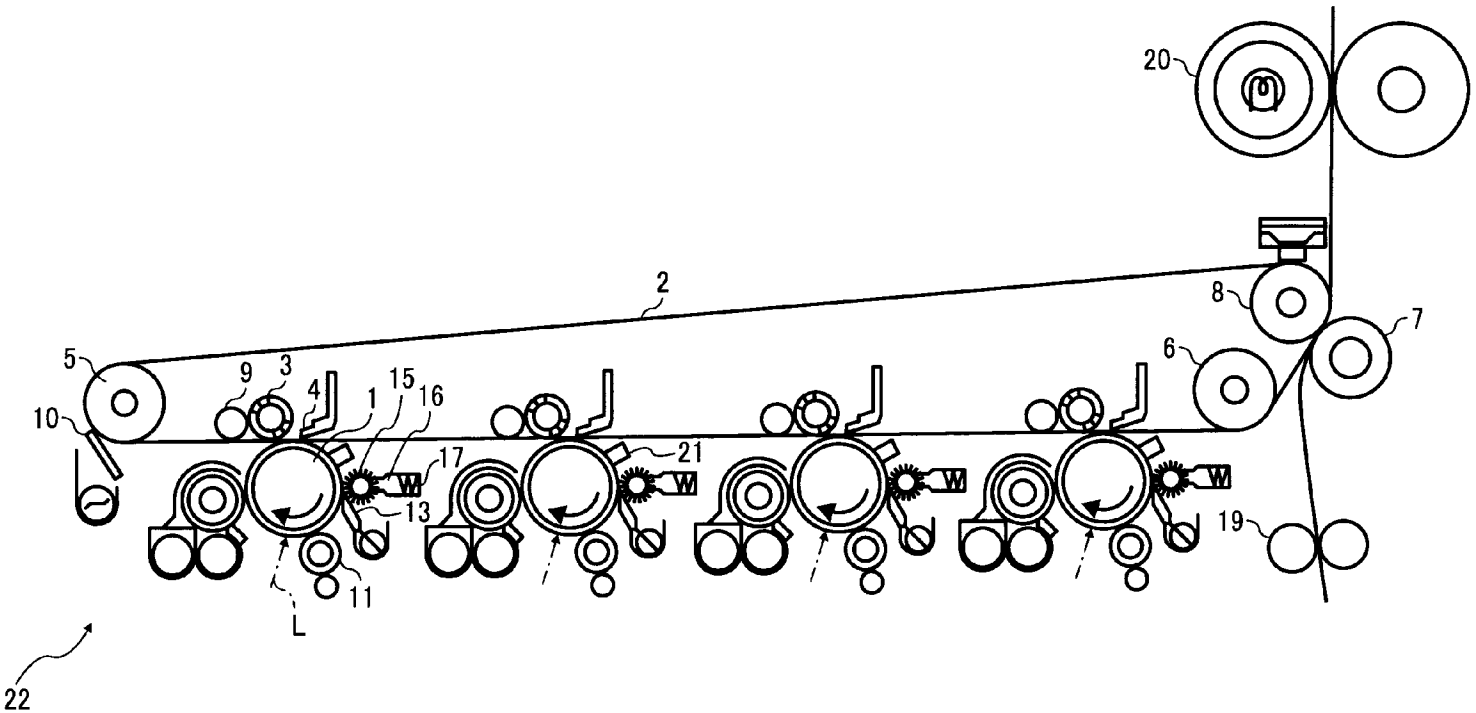
FIG. 1 is a schematic diagram of an example of an image forming apparatus according to the present invention.

FIG. 1 is a schematic diagram of an example of an image forming apparatus according to the present invention. As shown in FIG. 1, the image forming apparatus according to the present invention includes an image carrier a, an intermediate transfer belt 2, a primary transfer roller 3, a primary-transfer-nip outlet blade 4 (hereinafter, "outlet blade"), a tension roller 5, a driving roller 6, a secondary transfer roller 7, a secondary-transfer opposing roller 8, a winding roller 9, a belt cleaning unit 10, a charging roller 11, a photosensitive-element cleaning blade 13, a lubricant applying brush 15, a lubricant 16, a spring 17, a registration roller 19, a fixing unit 20, a neutralizing lamp 21, and a developing unit 22.

The image forming apparatus includes image carriers 1Y, 1C, 1M, and 1BK formed of four drum photosensitive elements, and a yellow toner image, a cyan toner image, a magenta toner image, and a black toner image are respectively formed on the circumference of the respective image carriers. The intermediate transfer belt 2 formed of an endless belt is provided opposite to the image carriers 1Y to 1BK. The intermediate transfer belt 2 is mainly entrained around the tension roller 5, the driving roller 6, and the secondary-transfer opposing roller 8. The intermediate transfer belt 2 is rotated and driven in a counterclockwise direction in FIG. 1, while coming in contact with the primary transfer roller 3, the primary-transfer-nip outlet blade 4, the secondary transfer roller 7, the winding roller 9, the belt cleaning unit 10, and the image carriers 1Y to 1BK, so that toner images on the respective image carriers 1Y to 1BK are superposed and primarily transferred on the intermediate transfer belt 2.

Figure 2:
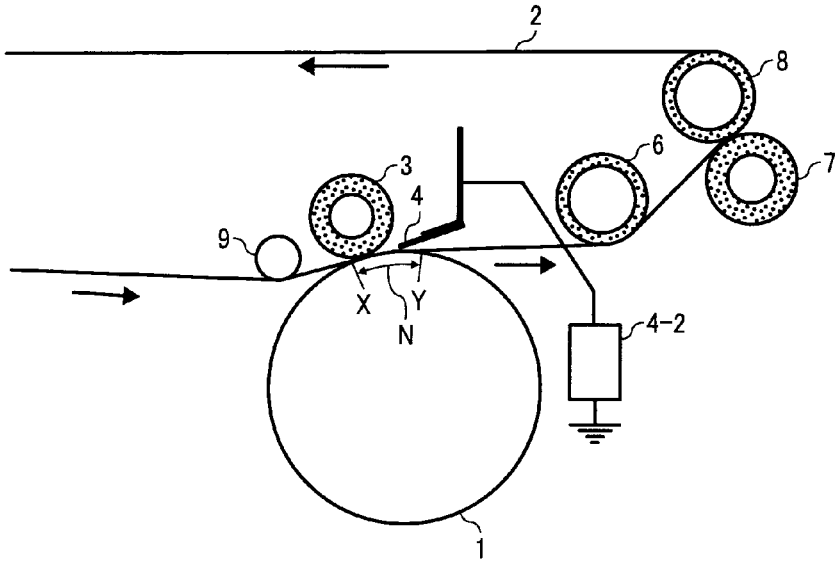
FIG. 2 is a partial enlarged view of a transfer station formed of a black photosensitive element.

FIG. 2 is a partial enlarged view of a transfer station formed of a black photosensitive element.

Because the configuration for forming a toner image on the respective image carriers 1Y to 1BK and the configuration for transferring the toner image onto the intermediate transfer belt 2 are the same with each other, only the configuration for forming the toner image on the image carrier 1BK and transferring the toner image onto the intermediate transfer belt 2 are explained with reference to FIGS. 1 and 2. The image carrier 1BK is driven in the clockwise direction in FIGS. 1 and 2, and charged to a predetermined polarity by the charging roller 11. It is assumed here that the charging polarity is negative polarity. Light-modulated write beams L (laser beams in this embodiment) emitted from an exposure unit (not shown) are irradiated onto a charged surface of the image carrier 1BK, thereby forming an electrostatic latent image on the image carrier, and the electrostatic latent image is visualized as a black toner image by the developing unit 22 of a reversal developing method. The developing unit 22 includes a developing roller applied with a development bias, and the electrostatic latent image is visualized as the toner image. A two-component developer having a toner and a carrier or a one-component developer not having the carrier is used as a dry developer. In any case, the toner is charged to a proper charging polarity (negative polarity in this embodiment), and the toner electrostatically is shifted to the electrostatic latent image formed on the image carrier 1BK, to visualize the electrostatic latent image.

On the other hand, the primary transfer roller 3 is arranged at a position substantially opposite to the image carrier 1BK, putting the intermediate transfer belt 2 therebetween. A transfer voltage of a reverse polarity to the proper charging polarity of the toner on the image carrier 1BK (positive polarity in the embodiment) is applied to the primary transfer roller 3, thereby forming an electric field between the image carrier 1BK and the intermediate transfer belt 2, so that the toner image on the image carrier 1BK is transferred onto the intermediate transfer belt 2 driven in the counterclockwise direction. The primary transfer roller 3 constitutes the transfer unit that primarily transfers the toner image on the image carrier onto the intermediate transfer belt 2. The primary transfer roller 3 abuts against the rear face of the intermediate transfer belt 2 on which the toner image is transferred. The transfer residual toner adhered to the image carrier 1BK is removed by the photosensitive-element cleaning blade 13 after the toner image is transferred, and neutralizing light is irradiated to the image carrier after transfer of the toner image by the neutralizing lamp 21, and the surface potential is initialized to prepare for the next imaging process.

The yellow toner image, the cyan toner image, and the magenta toner image are respectively formed on the other image carriers 1Y, 1C, and 1M shown in FIG. 1 in the same manner, and these toner images are sequentially superposed on and transferred to the intermediate transfer belt 2, to which the yellow toner image has been transferred, in an order of cyan, magenta, and black. Accordingly, a four-color superposed toner image is formed on the intermediate transfer belt 2.

The secondary transfer roller 7 for secondary transfer of the toner image is provided at a position facing the support roller 8 (secondary transfer opposing roller), putting the intermediate transfer belt 2 therebetween, and the registration roller 19 and a paper feeder (not shown) are arranged below the secondary transfer roller 7. A recording medium P as a final transfer member formed of transfer paper or a resin film fed from the paper feeder is fed to between the intermediate transfer belt 2 and the secondary transfer roller 7 at predetermined timing due to rotation of a pair of registration rollers 19. When the recording medium P passes through the secondary transfer roller 7 in this manner, a transfer voltage of a reverse polarity to the proper charging polarity of the toner of the toner image on the intermediate transfer belt 2 (positive polarity in the embodiment) is applied to the secondary transfer roller 7, thereby forming an electric field between the intermediate transfer belt 2 and the recording medium P, so that the toner image on the intermediate transfer belt 2 is electrostatically secondarily transferred to the recording medium P. The transfer residual toner adhered to the intermediate transfer belt 2 after transfer of the toner image is removed by the belt cleaning unit 10.

The recording medium P to which the toner image is transferred passes through the fixing unit 20, and the transferred toner image is fixed on the recording medium P by an action of heat and pressure at this time. The recording medium P having passed through the fixing unit 20 is ejected to a paper election unit (not shown). The recording medium P on which a full color image is formed can be obtained.

As described above, in the image forming apparatus in the embodiment, the toner image formed on the image carrier is primarily transferred onto the intermediate transfer belt driven while coming in contact with the image carrier, and the toner image on the intermediate transfer belt is secondarily transferred onto the recording medium, thereby obtaining the recorded image.

A configuration for preventing or effectively controlling generation of transfer dust, which adheres to around the toner image transferred from the image carrier to the intermediate transfer belt in a toner-scattered state, is explained next. Because the configurations for preventing the transfer dust of the toner image transferred from the respective image carriers 1Y to 1BK to the intermediate transfer belt 2 are substantially the same with each other, only the configuration for preventing the transfer dust of the toner image transferred from the image carrier 1BK to the intermediate transfer belt 2 is explained.

The intermediate transfer belt 2 driven in the counterclockwise direction comes in contact with the surface of the image carrier 1BK driven in a clockwise direction directly or via the toner, and the image carrier 1BK and the intermediate transfer belt 2 move at substantially the same speed in the same direction in the part coming in contact with each other.

As shown in FIG. 2, an area between the most upstream side position X and the most downstream side position Y in a moving direction of the intermediate transfer belt at the part where the intermediate transfer belt comes in contact with the image carrier 1BK is herein referred to as a contact area N. In the image forming apparatus in the embodiment, the primary transfer roller 3 (or a primary-transfer bias member such as a blade or brush) that abuts against the rear face of the intermediate transfer belt 2 in the contact area N is used as the primary transfer unit that primarily transfers the toner image on the image carrier 1BK to the intermediate transfer belt 2. The transfer voltage of the reverse polarity to the proper charging polarity of the toner (positive polarity in the embodiment) is applied to the primary transfer roller 3 by a bias power source (not shown). The applied voltage is, for example, about 0.8 kilovolts to 2 kilovolts. Accordingly, a transfer field is formed between the image carrier 1BK and the intermediate transfer belt 2, and the toner image on the image carrier 1BK is transferred onto the intermediate transfer belt 2.

A downstream-side neutralizing electrode (the primary-transfer-nip outlet blade 4) shown in FIG. 1 is provided in the image forming apparatus in the embodiment. The downstream-side neutralizing electrode abuts against the rear face of the intermediate transfer belt 2 at a position on the downstream side in the moving direction of the intermediate transfer belt than the position where the primary transfer roller 3 abuts against the intermediate transfer belt 2, and on the upstream side in the moving direction of the intermediate transfer belt than the most downstream side position Y. The voltage of relatively the same polarity as the proper charging polarity of the toner (negative polarity in an example shown in FIG. 1) rather than the applied voltage of the primary transfer roller 3 is applied to the downstream-side neutralizing electrode. The applied voltage is, for example, about +0.1 kilovolt to −1 kilovolt, and specifically, 0 volt to −400 volts is preferable for controlling a discharge phenomenon, which is likely to occur in a microvoid of about several tens micrometers between the image carrier (photosensitive drum) 1BK and the intermediate transfer belt 2 immediately after passage through the primary transfer nip (the contact area N). Due to the discharge phenomenon-controlling effect, the transfer dust generated immediately after passage through the primary transfer nip is improved, and the dust in the final image on the recording medium P obtained through a secondary transfer step, in which the image is transferred onto the recording medium P as the final transfer member formed of the transfer paper or the resin film fed from the paper feeder, and a fixing step is improved.

Because the primary transfer roller 3 applied with the transfer voltage of positive polarity abuts against the rear face of the intermediate transfer belt 2, a positive charge is imparted to the rear face of the intermediate transfer belt 2, and the charge moves along the rear face of the intermediate transfer belt 2 toward the microvoid on the primary transfer-nip outlet side. The charge held by the intermediate transfer belt 2 also moves toward the microvoid on the primary transfer-nip outlet side, with the movement of the intermediate transfer belt 2. However, because the downstream-side neutralizing electrode applied with the voltage of more negative polarity abuts against the position on the upstream side in the moving direction of the intermediate transfer belt than the most downstream side position Y in the primary transfer nip (the contact area N), positive charge is removed from the intermediate transfer belt 2. However, if the neutralizing charge amount is small at a point in time when the positive charge on the intermediate transfer belt has passed through the downstream-side neutralizing electrode, or when the discharge preventing unit in the present invention is not provided in the conventional image forming apparatus, discharge is likely to occur in the microvoid on the primary transfer-nip outlet side due to the residual charge immediately after passage through the primary transfer nip, thereby generating the transfer dust.

On the other hand, when the residual charge of positive polarity is appropriately removed due to the operation of the downstream-side neutralizing electrode while the part of the intermediate transfer belt 2 having passed through the downstream-side neutralizing electrode (the primary transfer-nip outlet blade 4 in the drawing) comes in contact with the image carrier 1BK, there is no residual charge sufficient for substantially generating the discharge on the intermediate transfer belt when the intermediate transfer belt is separated from the image carrier 1BK. Therefore, discharge does not occur in the microvoid on the primary transfer-nip outlet side. Accordingly, generation of the transfer dust in the toner image on the intermediate transfer belt can be prevented in the microvoid on the primary transfer-nip outlet side.

The primary-transfer-nip outlet blade 4 as the downstream-side neutralizing electrode is held by a support member made of a high resistance material with respect to a ground member and pressurized toward the intermediate transfer belt 2, and a vicinity of the end of the downstream-side neutralizing electrode sticks to the rear face of the intermediate transfer belt 2.

As described above, the downstream-side neutralizing electrode is provided in the image forming apparatus in the embodiment, so that generation of the transfer dust at the primary transfer-nip outlet can be suppressed. However, generation of the transfer dust on a primary transfer-nip inlet side can be suppressed according to an embodiment in which a winding amount of the intermediate transfer belt 2 by the winding roller 9 with respect to an image carrier 1 on the upstream side of the primary transfer roller 3 is several hundreds micrometers or more. Further, generation of the transfer dust on the primary transfer-nip inlet side can be suppressed by maintaining the potential of the winding roller 9 to a level at which discharge between the image carrier 1 and the intermediate transfer belt 2 on the primary transfer-nip inlet side does not occur (preferably less than 400 volts in an absolute value) and incorporating a resistor or a constant voltage element in a conductive circuit up to the ground member.

In the present invention, the primary-transfer bias member has a roller configuration. However, as described later, if the primary-transfer bias member has a blade configuration, the configuration becomes simple and cost reduction can be expected. However, the primary-transfer bias member requires high durability and high stability higher than that of the transfer-nip outlet side electrode, which is a characteristic component of the present invention. It is also important to take measures for preventing abnormal sounds of a transfer blade and suppressing wear and characteristic changes thereof.

If a gap between the primary transfer roller 3 and the downstream-side neutralizing blade is narrow, discharge can occur between these two members. If discharge occurs, transfer efficiency of the toner image from the image carrier 1BK to the intermediate transfer belt 2 decreases. Therefore, occurrence of discharge between these two members can be prevented by arranging a nonconductive sheet (not shown) between these two members and securing a base end of each nonconductive sheet to a support member. An edge portion of each nonconductive sheet preferably softly abuts against the rear face of the intermediate transfer belt 2 or maintains a slight gap therebetween to prevent the intermediate transfer belt 2 from being damaged. As a material for such a nonconductive sheet, for example, polyethylene terephthalate (PET) can be mentioned.

A technical outline relating to the primary transfer of the apparatus according to the present invention has been explained above. The primary-transfer-nip outlet blade 4 provided at the primary-transfer nip outlet has a merit in improving the image quality; however, if there is nonuniformity in the neutralizing effect due to contact nonuniformity or wear nonuniformity of the contact area, and nonuniformity in electrical resistance, there is a disadvantage in that a problem of nonuniformity in image density (nonuniformity in grayscale) can occur.

Therefore, in the present invention, a layer having high volume resistivity is provided on a surface or a substratum thereof of the neutralizing electrode (neutralizing member), or a constant voltage electrode with a voltage lower than the primary-transfer bias voltage (when the transfer bias is for constant current control, lower than a lower limit voltage of variation) is inserted so that there is no nonuniformity in the neutralizing effect, thereby preventing excessive removal of electricity from the toner and the transfer belt in this portion due to flowing of locally excessive neutralizing current.

Figure 3:
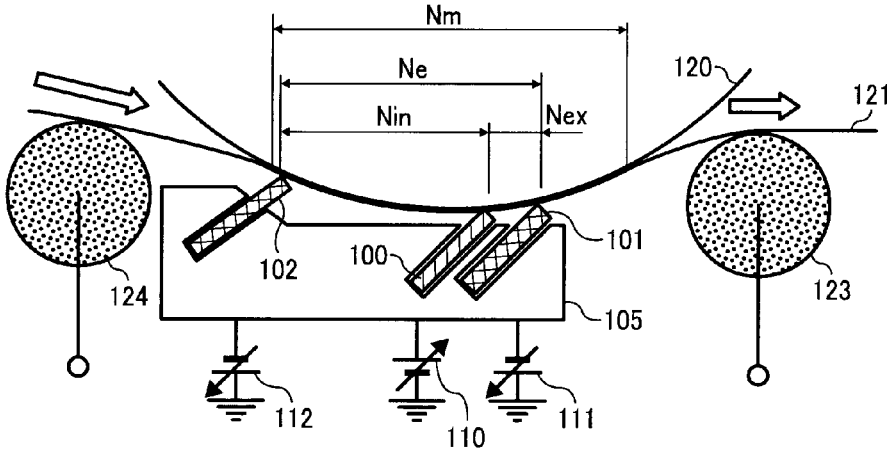
FIG. 3 is a schematic diagram for explaining an example in which a primary-transfer bias member has a blade configuration.

FIG. 3 is a schematic diagram for explaining an example in which the primary transfer bias member has the blade configuration, including a primary transfer blade 100, an outlet blade 101, an inlet blade 102, a holder 105 for respective blades, a bias source 110 for the transfer blade, a bias source 111 for the outlet blade, a bias source 112 for the inlet blade, a photosensitive element 120, an intermediate transfer belt 121, suspension rollers 123 and 124, a mechanical nip Nm, an effective bias width of the primary transfer field Ne, a distance from the inlet blade to the primary transfer blade Nin, and a distance from the primary transfer blade to the outlet blade Nex, where Ne=Nin+Nex, and Nm≧Ne.

Figure 4A:
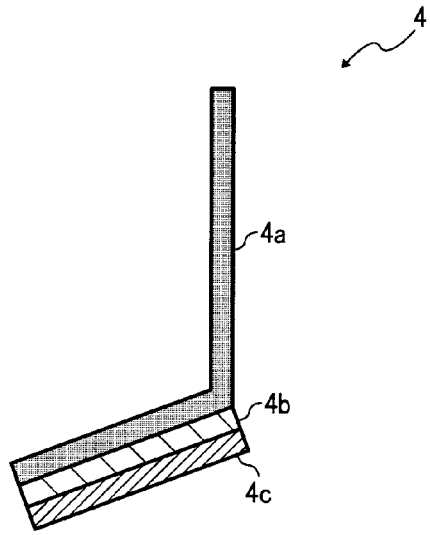
FIGS. 4A and 4B are schematic diagrams for explaining an example in which a layer having high volume resistivity is provided in a part of a neutralizing electrode.
Figure 4B:
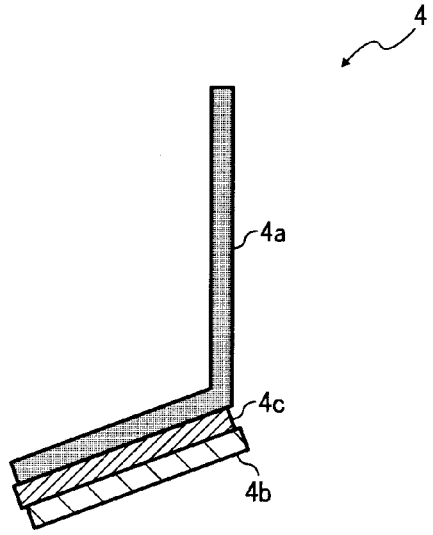

FIGS. 4A and 4B are schematic diagrams for explaining an example in which a layer having high volume resistivity is provided in a part of the neutralizing electrode. FIG. 4A is an example in which a contact layer with the intermediate transfer belt is made of a high-resistivity member, and FIG. 4B is an example in which the high-resistivity member is provided between the contact layer with the intermediate transfer belt and a blade base metal.

In FIGS. 4A and 4B, reference numeral 4*a* denotes a metal substrate, 4*b* denotes a low to medium resistor, and 4*c* denotes a high resistor. A measurement method of a resistance is as described below.

The Hiresta UP HCP-HT450 manufactured by Mitsubishi Chemical Corporation is used as a measuring device, a UR probe is used, and the measurement time is 10 seconds. The applied voltage can be switched between 100 volts to 500 volts.

In both cases shown in FIGS. 4A and 4B, the edge of the blade has resilience such that the edge abuts against the intermediate transfer belt with slight bending.

To perform experiments, various examples were created with the characteristic of the neutralizing blade being variously changed, together with a plurality of comparative examples. The resistance was measured by applying 100 volts in all examples. Conditions of respective examples of experiment are as described below, and evaluation of density uniformity as a result of experiments is shown in Table 1.

A part where there is no numerical description in surface resistance indicates that measurement was not available.

EXAMPLE 1

<Rear Face Layer of Intermediate Transfer Belt>

| | |
|---|---|
| Volume resistivity | $\rho v = 3.16 \times 10^9\ \Omega \cdot cm$ |
| Surface resistivity | $\rho s = 1.58 \times 10^{10}\ \Omega/\square$ |
| Thickness | t = 60 μm |

<Coating Layer of Primary-Transfer Bias Roller>

| | |
|---|---|
| Volume resistivity | $\rho v = 3.16 \times 10^7\ \Omega \cdot cm$ |
| Surface resistivity | $\rho s = \Omega/\square$ |
| Thickness | t = 3 μm |

<Front Sheet of Neutralizing Blade>

[Surface Layer: Layer on Intermediate Transfer Belt Side]

| | |
|---|---|
| Volume resistivity | $\rho v = 7.94 \times 10^8\ \Omega \cdot cm$ |
| Surface resistivity | $\rho s = 3.98 \times 10^9\ \Omega/\square$ |
| Thickness | t = 50 μm |

[Interlayer: Including Adhesive]

| | |
|---|---|
| Volume resistivity | $\rho v = 1.00 \times 10^4\ \Omega \cdot cm$ or less |
| Surface resistivity | $\rho s = \Omega/\square$ |
| Thickness | t = 30 μm |

EXAMPLE 2

<Rear Face Layer of Intermediate Transfer Belt>, <Coating Layer of Primary-Transfer Bias Roller>

Same as in the first embodiment (these are the same in all embodiments and comparative examples, and therefore descriptions of these items are omitted)

<Front Sheet of Neutralizing Blade>

[Surface Layer: Layer on Intermediate Transfer Belt Side]

| | |
|---|---|
| Volume resistivity | $\rho v = 3.16 \times 10^8\ \Omega \cdot cm$ |
| Surface resistivity | $\rho s = 3.98 \times 10^9\ \Omega/\square$ |
| Thickness | t = 50 μm |

[Interlayer: Including Adhesive]

| | |
|---|---|
| Volume resistivity | $\rho v = 1.00 \times 10^4\ \Omega \cdot cm$ or less |
| Surface resistivity | $\rho s = \Omega/\square$ |
| Thickness | t = 30 μm |

EXAMPLE 3

<Front Sheet of Neutralizing Blade>

[Surface Layer: Layer on Intermediate Transfer Belt Side]

| | |
|---|---|
| Volume resistivity | $\rho v = 3.16 \times 10^{7}\ \Omega \cdot cm$ |
| Surface resistivity | $\rho s = 5.01 \times 10^{8}\ \Omega/\square$ |
| Thickness | t = 25 μm |

[Interlayer: Including Adhesive]

| | |
|---|---|
| Volume resistivity | $\rho v = 1.58 \times 10^{9}\ \Omega \cdot cm$ or less |
| Surface resistivity | $\rho s = 6.31 \times 10^{9}\ \Omega/\square$ |
| Thickness | t = 30 μm |

EXAMPLE 4

<Front Sheet of Neutralizing Blade>

[Surface Layer: Layer on Intermediate Transfer Belt Side]

| | |
|---|---|
| Volume resistivity | $\rho v = 1.58 \times 10^{10}\ \Omega \cdot cm$ |
| Surface resistivity | $\rho s = 3.16 \times 10^{11}\ \Omega/\square$ |
| Thickness | t = 25 μm |

[Interlayer: Including Adhesive]

| | |
|---|---|
| Volume resistivity | $\rho v = 1.00 \times 10^{4}\ \Omega \cdot cm$ or less |
| Surface resistivity | $\rho s = \Omega/\square$ |
| Thickness | t = 30 μm |

EXAMPLE 5

<Front Sheet of Neutralizing Blade>

[Surface Layer: Layer on Intermediate Transfer Belt Side]

| | |
|---|---|
| Volume resistivity | $\rho v = 3.16 \times 10^{7}\ \Omega \cdot cm$ |
| Surface resistivity | $\rho s = 5.01 \times 10^{8}\ \Omega/\square$ |
| Thickness | t = 25 μm |

[Interlayer: Including Adhesive]

| | |
|---|---|
| Volume resistivity | $\rho v = 6.31 \times 10^{9}\ \Omega \cdot cm$ or less |
| Surface resistivity | $\rho s = 1.00 \times 10^{11}\ \Omega/\square$ |
| Thickness | t = 30 μm |

COMPARATIVE EXAMPLE 1

<Front Sheet of Neutralizing Blade>

[Surface Layer: Layer on Intermediate Transfer Belt Side]

| | |
|---|---|
| Volume resistivity | $\rho v = 2.00 \times 10^{4}\ \Omega \cdot cm$ |
| Surface resistivity | $\rho s = 3.16 \times 10^{5}\ \Omega/\square$ |
| Thickness | t = 50 μm |

[Interlayer: Including Adhesive]

| | |
|---|---|
| Volume resistivity | $\rho v = 1.00 \times 10^{4}\ \Omega \cdot cm$ or less |
| Surface resistivity | $\rho s = \Omega/\square$ |
| Thickness | t = 30 μm |

COMPARATIVE EXAMPLE 2

<Front Sheet of Neutralizing Blade>

[Surface Layer: Layer on Intermediate Transfer Belt Side]

| | |
|---|---|
| Volume resistivity | $\rho v = 3.16 \times 10^{7}\ \Omega \cdot cm$ |
| Surface resistivity | $\rho s = 5.01 \times 10^{8}\ \Omega/\square$ |
| Thickness | t = 50 μm |

[Interlayer: Including Adhesive]

| | |
|---|---|
| Volume resistivity | $\rho v = 1.00 \times 10^{4}\ \Omega \cdot cm$ or less |
| Surface resistivity | $\rho s = \Omega/\square$ |
| Thickness | t = 30 μm |

It is evaluated whether the density of the image becomes uniform as desired in the configuration under such conditions. Regarding the density uniformity, if it is excellent, an evaluation value is represented by o, if it is at an allowable lower limit, the evaluation value is represented by Δ, and if it is not allowable, the evaluation value is represented by x. The result is shown in Table 1. However, because the evaluation of the resistance requires a long expression, a common logarithm (in the table, expressed as "log") is adopted, and rounded up to the first decimal place.

Sign [–] in the surface resistance column in Table 1 indicates that measurement has not been possible.

TABLE 1

| Volume resistivity of intermediate transfer belt ($\log\rho v_1$) | Volume resistivity of primary transfer bias roller ($\log\rho s_1$) | Examples | Front sheet of neutralizing blade: Surface layer (layer on intermediate transfer belt side) Volume resistivity ($\log\rho v_2$) | Surface layer Surface resistivity ($\log\rho s_2$) | Surface layer Thickness (μm) | Interlayer (including adhesive) Volume resistivity ($\log\rho v_2$) | Interlayer Surface resistivity ($\log\rho s_2$) | Interlayer Thickness (μm) | Evaluation Of density uniformity |
|---|---|---|---|---|---|---|---|---|---|
| 9.5 | 7.5 | Example 1 | 8.9 | 9.6 | 50 | 4.0 or less | — | 30 | ○ |
| | | Example 2 | 8.5 | 9.6 | 50 | 4.0 or less | — | 30 | ○ |
| | | Example 3 | 7.5 | 8.7 | 25 | 9.2 | 9.8 | 30 | ○ |
| | | Example 4 | 10.2 | 11.5 | 50 | 4.0 or less | — | 30 | ○ |
| | | Example 5 | 7.5 | 8.7 | 25 | 9.8 | 11.0 | 30 | ○ |
| | | Comparative example 1 | 4.3 | 5.5 | 50 | 4.0 or less | — | 30 | Δ |
| | | Comparative example 2 | 7.5 | 8.7 | 50 | 4.0 or less | — | 30 | x |

It is understood from the results that the quality of density uniformity depends on a relationship between the volume resistivity $\rho v_1$ of the intermediate transfer belt or the primary-transfer bias roller and the volume resistivity $\rho v_2$ of the front sheet of the neutralizing blade. However, the volume resistivity $\rho v_2$ of the front sheet of the neutralizing blade means both the volume resistivity of the surface layer and the volume resistivity of the interlayer, and if the digits thereof are deviated from each other by two digits, the larger volume resistivity is used as a representative value.

For example, when a ratio of the volume resistivity ($\rho v_2$) of the front sheet of the neutralizing blade to the volume resistivity ($\rho v_1$) of the intermediate transfer belt is compared with the evaluation result of the density uniformity, it is understood that when the ratio becomes a particular value or higher, the density uniformity is improved (the density nonuniformity decreases).

To easily understand the relationship thereof, the relationship is integrated in Table 2 and a graph. However, in Table 2, magnitude correlation is sorted out and arranged, noting the ratio of volume resistivity.

TABLE 2

| | Ratio of volume resistivity $\rho v_2/\rho v_1$ | Density nonuniformity ΔID | Evaluation result of density uniformity |
|---|---|---|---|
| Example 4 | 5.01187 | 0.03 | ○ (Excellent) |
| Example 5 | 1.99526 | 0.07 | ○ (Excellent) |
| Example 3 | 0.50119 | 0.15 | ○ (Excellent) |
| Example 1 | 0.25119 | 0.21 | ○ (Excellent) |
| Example 2 | 0.10000 | 0.28 | ○ (Excellent) |
| Comparative example 2 | 0.01000 | 0.37 | Δ (Allowable lower limit) |
| Comparative example 1 | 0.00001 | 0.48 | X (Bad) |

Figure 5:
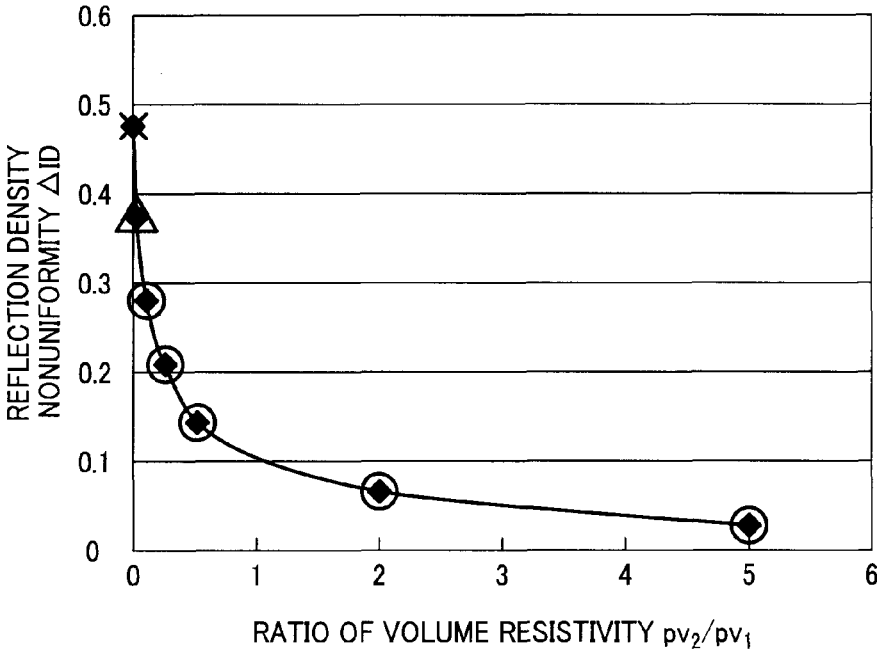
FIG. 5 is a graph of a relationship shown in table 2.
Figure 6:
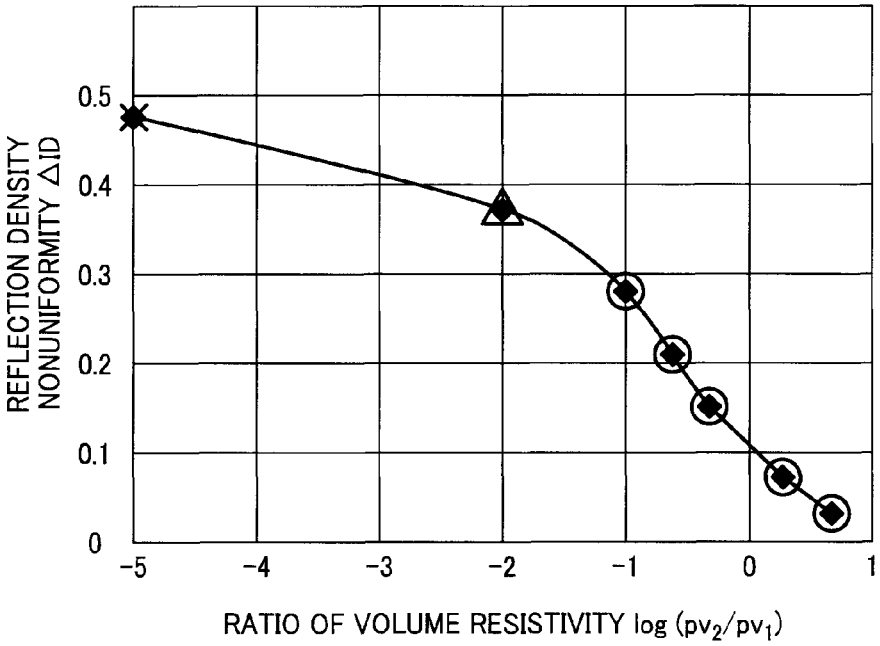
FIG. 6 is another graph of the relationship shown in table 2.

FIGS. 5 and 6 are graphs of the relationship shown in table 2. In FIG. 5, numerical values in Table 2 are directly used, and FIG. 6 is a graph drawn by obtaining the common logarithm of the ratio of volume resistivity.

In these drawings, a sign expressing the evaluation result is shown at each data point.

It is understood from these graphs that the evaluation result deteriorates when the reflection density nonuniformity becomes 0.3 or higher, and the evaluation result deteriorates when the common logarithm of the ratio of volume resistivity becomes −1 or lower.

When it is considered that the volume resistivity is smaller than −1, without taking the common logarithm, it indicates that the ratio of volume resistivity is smaller than 1/10. Conversely, it means that if the ratio of volume resistivity is larger than 1/10, excellent evaluation result can be obtained.

Further, when the magnitude correlation between the volume resistivity ($\rho v_3$) of the primary-transfer bias roller and the volume resistivity ($\rho v_2$) of the front sheet of the neutralizing blade is compared with the evaluation result of the density uniformity, it is understood that the density uniformity is improved (the density nonuniformity decreases) when the volume resistivity $\rho v_3$ of the bias roller is smaller than the volume resistivity $\rho v_2$ of the neutralizing blade.

To confirm this relationship, a ratio between the volume resistivity $\rho v_3$ and the volume resistivity $\rho v_2$ is taken. That is, the relationship is seen based on a value obtained by dividing the volume resistivity $\rho v_2$ of the neutralizing blade by the volume resistivity $\rho v_3$ of the bias roller. If this value is larger than 1, it means that the volume resistivity $\rho v_2$ of the neutralizing blade is larger than the volume resistivity $\rho v_3$ of the bias roller. For the volume resistivity, values in Table 1 obtained by taking the common logarithm are used. Therefore, the ratio between these volume resistivities can be expressed by a difference of values shown in Table 1. If the difference is positive, the ratio is larger than 1. This relationship is integrated in Table 3.

TABLE 3

| | Ratio of volume resistivity $\rho v_2/\rho v_1$ | Density nonuniformity ΔID | Evaluation result of density uniformity |
|---|---|---|---|
| Example 4 | 2.7 | 0.03 | ○ (Excellent) |
| Example 5 | 2.3 | 0.07 | ○ (Excellent) |
| Example 3 | 1.7 | 0.15 | ○ (Excellent) |
| Example 1 | 1.4 | 0.21 | ○ (Excellent) |
| Example 2 | 1.0 | 0.28 | ○ (Excellent) |
| Comparative example 2 | 0.0 | 0.37 | Δ (Allowable lower limit) |
| Comparative example 1 | −3.2 | 0.48 | X (Bad) |

In Comparative example 2, the logarithm in the volume ratio of volume resistivity becomes 0, which is expressed by 1 in the ratio. However, because the evaluation result of Comparative example 2 is Δ, it is preferable not to use this example. Therefore, it becomes a condition to obtain an excellent evaluation result that the above ratio is larger than 1, that is, the volume resistivity of the neutralizing blade is larger than the volume resistivity of the bias roller.

Figure 7:
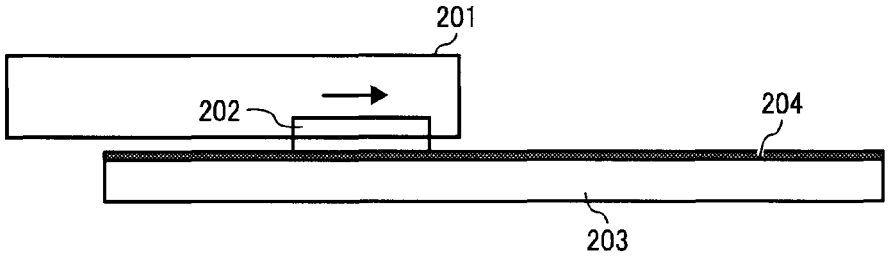
FIG. 7 depicts a method for measuring a coefficient of friction of a front sheet by the neutralizing electrode (neutralizing member)

FIG. 7 depicts a method for measuring a coefficient of friction of the front sheet of the neutralizing electrode (neutralizing member).

In FIG. 7, reference numeral 201 denotes a friction-coefficient measuring device, 202 denotes a slider, 203 denotes an outlet bias blade, and 204 denotes a surface of the outlet bias blade.

The MUSE TYPE:94iII, manufactured by SHINTO Scientific CO., Ltd., is used for the measuring device. The measurement area is from 0.000 to 1.300 and display resolution is 0.001. A Vinyl Chloride Monomer (VCM) photosensor is used for a detector. A 7-segment LED is used for a display unit, which can display four digits.

A slider obtained by hard chromium plating on brass is used for the slider, which has a weight of 40 grams.

The slider is brought into close contact with a horizontally held surface of a detection object, and the friction-coefficient measuring device is horizontally moved in one direction as shown by arrow. A displayed value (maximum static friction coefficient) when the slider starts to move is taken as the friction coefficient.

When the friction coefficient of the surface of the neutralizing electrode coming in contact with the intermediate transfer belt, which is obtained according to the measurement method, is set to 0.5 or lower by using a well-known material having an excellent self-lubricating property such as fluororesin, a suppressing effect of wear due to friction and an effect of preventing a foreign substance from adhering thereto.

It is desired that the rear face of the intermediate transfer belt 2 coming in contact with the primary-transfer-nip outlet blade 4 has a small friction coefficient. However, because the intermediate transfer belt 2 is rotated without slip in friction drive such as drive by a roller, there is a limitation in decreasing the friction coefficient of the rear face of the intermediate transfer belt coming in contact with the neutralizing member, and at least 0.3 or higher is preferable. Accordingly, it is desired that the friction coefficient of the rear face of the intermediate transfer belt 2 is set to 0.3 to 0.5 in view of a practical aspect. By setting the friction coefficient to this range, space saving of the neutralizing member provided on the primary-transfer nip outlet side, cost reduction, wear due to friction, and prevention of the foreign substance from adhering can be realized.

Because the primary transfer roller 3 and the intermediate transfer belt 2 fundamentally move at the same speed, there is almost no relative sliding between these members, and therefore it is not necessary to take into consideration the wear of the member due to sliding. However, because the base of the primary-transfer-nip outlet blade 4 is fixed, there is a relative movement between the intermediate transfer belt 2 and the primary-transfer-nip outlet blade 4 due to the speed of the belt. Because the contact area therebetween generates heat locally due to frictional heat and the heat is accumulated, softening of the member can occur according to a material used therefor.

Accordingly, it is particularly important to set the contact pressure between the intermediate transfer belt 2 and the primary-transfer-nip outlet blade 4 and to select the material.

In selecting the material, when polyimide generally used for the intermediate transfer belt 2 is used, polyimide is hard, strong, and hardly worn. If a hardly worn material is also used for the primary-transfer-nip outlet blade 4, when the foreign substance or a part of the heat-softened member adheres to the contact area, the primary-transfer-nip outlet blade 4 cannot be separated easily, and the intermediate transfer belt 2 can be damaged deeply.

On the other hand, if the primary-transfer-nip outlet blade 4 is made of a relatively easily worn material, when the primary-transfer-nip outlet blade 4 is worn out, the foreign substance is likely to be carried by the intermediate transfer belt 2 together with abrasive dust, which can be removed by the cleaning unit. That is, damage is likely to be caused in the neutralizing member side, which can be replaced relatively easily at a low cost, without giving a fatal damage to the intermediate transfer belt 2, which is effective in reduction of service cost.

For the end of the primary-transfer-nip outlet blade 4, a material softer than polyimide and having a low friction coefficient such as PFA is preferable, and the hardness of the material can be set to a range from 35 to 100 in the international rubber hardness degrees (IRHD). If the hardness is set to this range, wear is generated slightly. However, the degree thereof is quite light, adhesion of foreign substance hardly occurs, and the surface of the transfer belt, which is a sliding mating member, is hardly worn out.

As the contact pressure when the material having such hardness is used, a low pressure as shown below is preferable.

The friction coefficient of the rear face of the intermediate transfer belt 2 needs to be 0.3 or higher and cannot be decreased much. Therefore, the contact pressure is made as small as possible. According to an optimum value obtained by experiments, it is found that if a mean pressure per unit length in a width direction of the transfer belt is set to 30 g/cm or less, the end of the primary-transfer-nip outlet blade 4 is slightly worn out, but the service life thereof is not so short. However, the mean pressure needs to larger than 0 g/cm.

As a configuration directly associated with the contact pressure, there is an apparent bite amount of the primary-transfer-nip outlet blade 4 with respect to the intermediate transfer belt 2, that is, a distance between a position of the end of the primary-transfer-nip outlet blade 4 when the intermediate transfer belt 2 is not provided and the position thereof when the intermediate transfer belt 2 is provided. When this distance is 0, the contact pressure becomes 0, and the contact pressure increases as the distance increases.

Bias application is suspended at the time of non-transfer, and therefore the contact pressure needs to be released. Thus, if the above distance is too large, a release mechanism becomes large, which is not convenient. Accordingly, it is practical that the bite amount enabling to decrease the release mechanism while obtaining a desired pressure is set to be larger than 0 millimeter and smaller than about 1.5 millimeters. Thus, reliable abutment against the photosensitive element via the intermediate transfer belt can be realized, and release of the primary-transfer-nip outlet blade 4 can be simplified.

The material of the end of the primary-transfer-nip outlet blade 4 can be selected from materials having electric characteristics similar to those of the material of the intermediate transfer belt 2. When the material is selected, taking the friction coefficient and wear property into consideration, if a material contained in the intermediate transfer belt 2 is included therein to some extent, the following effects can be obtained.

That is, even if the abrasive dust due to friction adheres to the abutment mating member (belt), because the abrasive dust has the similar electric characteristics (electrical resistance, dielectric constant, and the like) to those of the abutment mating member, a deterioration change of the bias voltage-application function of the primary transfer roller gradually proceeds, as compared with an instance of sliding and wear between materials having different electric characteristics, thereby enabling high durability.

According to the experiments, it is found that when an abrasive substance in the neutralizing electrode adheres to the rear face of the intermediate transfer belt, load characteristics of the primary transfer bias does not change largely, and as a range capable of reliably avoiding a transfer problem such as transfer nonuniformity, the material of the end of the primary-transfer-nip outlet blade 4 can be selected from materials at least 50% the same as the contact face of the intermediate transfer belt. Even if the material at maximum 100% the same as the contact face is used, the effect does not change. Accordingly, even if adhesion of the abrasive dust is generated, because the abrasive dust has the similar electric characteristics (electrical resistance, dielectric constant, and the like) to those of the abutment mating member, a function deterioration change of the primary-transfer-nip outlet blade 4 gradually proceeds, as compared with an instance of sliding and wear between materials having different electric characteristics, thereby enabling high durability.

When the intermediate transfer belt 2 is reversed sometimes, even if the abrasive dust adheres to the abutment mating member, the abrasive dust mass, which accumulates in, is compressed on, and adheres to the end portion of the downstream-side neutralizing electrode, moves from the end portion and decreases, to make the function deterioration change of the primary-transfer-nip outlet blade 4 gradual, thereby enabling to improve the durability. As the reversed timing, when a user notices transfer nonuniformity in the image quality, the user can perform a specific operation. However, preferably, a point in time earlier than the accumulation timing of the abrasive dust expected in the design can be set as a predetermined operating time (or a predetermined number of image formation), and the intermediate transfer belt 2 can be reversed regularly with the predetermined interval. The number of reverse rotation is not particularly limited, however, a plurality of times is preferable rather than once, if possible. Accordingly, even if the abrasive dust due to friction adheres to the abutment mating member, the abrasive dust mass, which accumulates in, is compressed on, and adheres to the end portion of the primary-transfer-nip outlet blade 4, moves from the end portion and decreases due to the reverse rotation of the transfer belt, to make the function deterioration change of the primary-transfer-nip outlet blade 4 gradual, thereby enabling to improve the durability.

Preferably, a lubricant can be supplied to the rear face of the intermediate transfer belt 2, restricted to the contact portion at the end of the primary-transfer-nip outlet blade 4, to decrease the frictional resistance.

For example, if a known lubricant such as zinc stearate is supplied, the frictional force can be reduced, thereby enabling to reduce an abrasion loss and realize high durability. A supply method is not particularly shown in the drawing, however, because the supply amount can be small, a conventionally known arbitrary method can be used. Accordingly, function deterioration of the primary-transfer-nip outlet blade 4 due to adhesion of the abrasive dust in the sliding portion of the primary-transfer-nip outlet blade 4 can be prevented and high durability can be realized.

Figure 8:
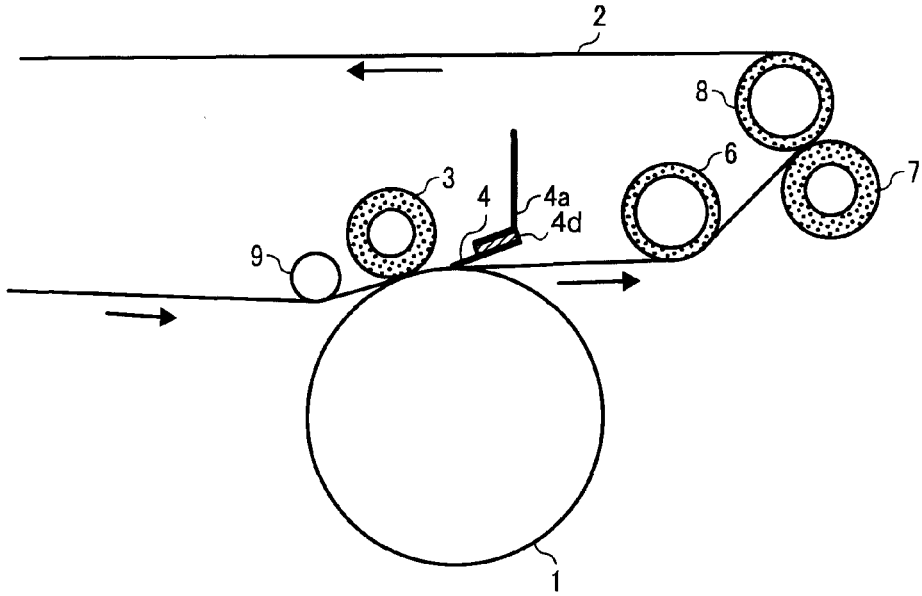
FIG. 8 depicts a configuration in which a damping member is attached to an outlet blade.

FIG. 8 depicts a configuration in which a damping member is attached to the outlet blade.

In FIG. 8, reference numeral 4*d* denotes the damping member. Other numerals are the same as those in FIG. 2.

Although not shown, the base of the primary-transfer-nip outlet blade 4 is fixed to a fixing member on the main unit side, and the end of the primary-transfer-nip outlet blade 4 comes in contact with the intermediate transfer belt 2 with slight pressure (such that the end bends). Accordingly, even when the intermediate transfer belt 2 moves at a predetermined speed, the primary-transfer-nip outlet blade 4 does not move. However, because the end of the outlet blade is made of an elastic member, a small change can occur due to vibrations. The vibrations can affect an image transfer unit via the intermediate transfer belt. As shown in FIG. 8 as an example, the damping member 4*d* is put between the end portion of the outlet blade 4 and the metal substrate 4*a*. Accordingly, even if a transitional phenomenon occurs, which causes vibrations, continuous vibrations are not caused thereby.

Vibrations in the contact area between the primary-transfer-nip outlet blade 4 and the intermediate transfer body can be prevented not only by the example shown in FIG. 8, but also by constructing the surface of the primary-transfer-nip outlet blade 4 coming in contact with the intermediate transfer body by a damping structure (damping member, a member that comes in contact with the damping member, or a member formed integrally with the damping member). Accordingly, primary transfer nonuniformity due to compression of the toner (including hollow image, uneven fogging, and edge ragged image), wear of the contact area between the primary-transfer-nip outlet blade 4 and the intermediate transfer body, and characteristic change can be reduced.

Figure 9A:
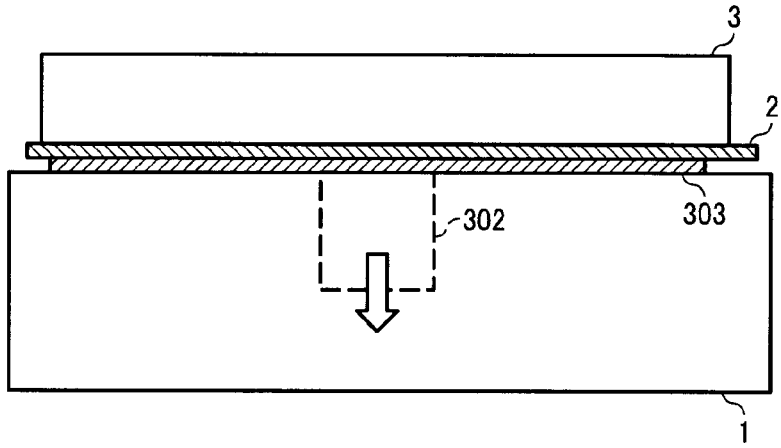
FIGS. 9A and 9B are schematic diagrams for explaining a pressure measuring method of a primary transfer nip.
Figure 9B:
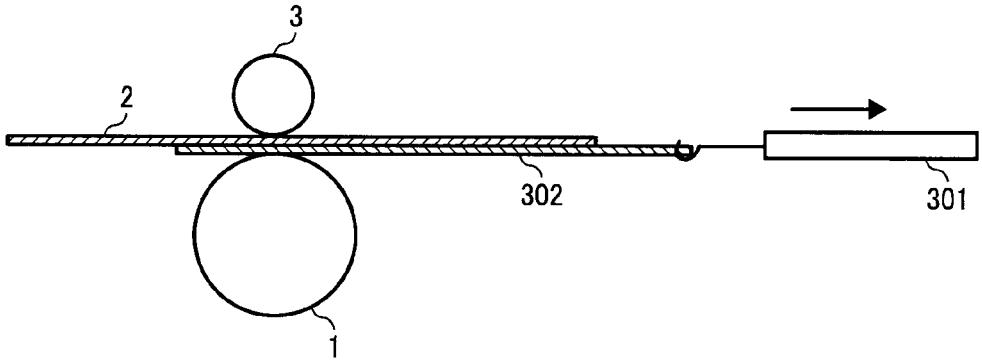

FIGS. 9A and 9B are schematic diagrams for explaining a pressure measuring method in the primary transfer nip. FIG. 9A is a diagram as seen from the front in the belt moving direction, and FIG. 9B is a diagram as seen in a direction of a roller axis.

In FIGS. 9A and 9B, reference numeral 301 denotes a tension gauge, 302 denotes a pressure-measuring thin strip sheet, and 303 denotes a pressure-balance maintaining sheet.

In the measurement, the pressure-measuring thin strip sheet 302 is put between the photosensitive drum 1 and the intermediate transfer belt 2 with the photosensitive drum 1, the intermediate transfer belt 2, and the primary transfer roller 3 being respectively fixed, and one end of the pressure-measuring thin strip sheet 302 is pulled parallel to the nip by the tension gauge 301. Because the pressure-measuring thin strip sheet 302 is pulled at one point by the tension gauge, a width corresponding to the whole width of the nip is not required for the pressure-measuring thin strip sheet 302, and therefore the sheet is a thin strip form. Accordingly, a plurality of pressure-balance maintaining sheets 303 is put between the photosensitive drum land the primary transfer roller 3 to avoid an occurrence of stress concentration in the pressure measuring thin strip sheet 302 due to a contact pressure of the primary transfer roller 3 to the photosensitive drum 1.

The measuring method of the contact pressure has been explained, taking the primary transfer nip as an example, however, the contact pressure of the primary-transfer-nip outlet blade 4 to the intermediate transfer belt 2 or the like is also measured by the same method. However, the pressure measuring method is not limited to the above method, and conventionally known various methods such as a method of using a pressure sensitive sensor, and calculating the pressure based on the volume of deformation of a pressing spring, a weight of a pressurized part, or the like can be applied. To convert the pressure per unit length to a surface pressure, the pressure per unit length needs only to be divided by an average nip width.

While key elements, the developer, and the like are generally known, a supplementary explanation is given below.

As the intermediate transfer belt, it is desired to use a belt hardly expanding or contracting for suppressing an occurrence of expansion and contraction of the image. In the image forming apparatus, a single-layer belt including a single-layer belt substrate made of polyimide (PI) is used as the intermediate transfer belt. As the materials of the intermediate transfer belt other than PI, well-known thermoplastic resins, thermoplastic elastomer, and thermosetting resins can be exemplified. For example, vinylidene fluoride (PVDF), polyethylene-tetrafluoroethylene (ETFE), polycarbonate (PC), polyester resin, polyamide resin, polyurethane resin, polyether resin, and polyvinyl resin can be exemplified. Mixed composite materials, in which conductive particles or conductive powders are distributed in these resins to adjust the electrical resistance, are used as the material of the belt. As the volume resistivity, $10^7$ Ω·cm to $10^{13}$ Ω·cm is preferable, if the voltage level of the primary transfer bias applied at the time of primary transfer is about 1 kilovolt, and the surface resistance of the rear face, to which the primary transfer bias is applied, is preferably about $10^9$ Ω·□. As the electrode to be used at the time of measurement of the electrical resistance, it is desired to use a thin and flexible electrode having a thickness of 50 micrometers to 200 micrometers, with an outside diameter of a main electrode being ϕ5.9 millimeters, an inside diameter of a guard electrode being ϕ11.0 millimeters, and an outside diameter of the guard electrode being ϕ17.8 millimeters. A voltage of about 500 volts is applied to the material with such an electrode, and the electrical resistance is obtained from a value of the current flowing between both electrodes.

As the conductive material for adjusting the resistance of the intermediate transfer body, one or two or more kinds can be mixed and used from metal powders such as carbon, aluminum, and nickel, metal oxide such as titanium oxide, and conductive high molecular compounds such as quaternary ammonium salt-containing polymethyl methacrylate, polyvinyl aniline, polyvinyl pyrrole, polydiacetylene, polyethyleneimine, boron-containing high molecular compound, and polypyrrole.

As the toner, the one obtained by mixing a charge control agent (CCA) and a coloring material in a particle matrix resin such as polyester, polyol, styrene acrylic resin, and externally adding a substance such as silica or titanium oxide around the particles, to increase the charging characteristic and fluidity thereof, is used. The particle size of the additive is preferably in a range of 0.1 micrometer to 1.5 micrometers. Carbon black, phthalocyanine blue, quinacridone, and carmine can be exemplified as the coloring material.

The proper charging polarity of the toner is negative as explained above in the embodiment. The toner obtained by externally adding the additive described above around the matrix resin including a wax or the like distributed and mixed therein can be used as the toner. The toner manufactured by a crushing method or polymerization method can be used. However, the toner manufactured by the polymerization method has relatively high sphericity and circularity, and therefore high image quality can be obtained.

It is desired to use the toner having a shape factor of 90% or higher. The shape factor originally means the sphericity and is defined by "the surface area of a sphere of the same volume as the particle divided by the actual surface area of the particle, and multiplied by 100%". However, because the measurement becomes quite difficult, the shape factor is calculated by the circularity. The shape factor can be obtained by a formula of "the circumference of a sphere of the same projected area as the particle divided by a length of the actual projected outline of the particle, and multiplied by 100%". The solution of the circularity approaches 100% as the image projecting toner particles approaches a perfect circle. The volume average particle size of the toner is preferably in a range of 3 micrometers to 12 micrometers. In the printer, the toner having the volume average particle size of 6 micrometers is used, and the toner can sufficiently correspond to an image having a high resolution of 1200 dpi or higher.

Magnetic particles containing a magnetic material such as ferrite and using metal or resin as a core, with the surface layer being covered with a silicone resin or the like, is used as the magnetic carrier. The particle size thereof is preferably in a range of 20 micrometers to 50 micrometers. The resistance of the magnetic particles is preferably in a range of $10^4$ Ω to $10^6$ Ω in a dynamic resistance. The dynamic resistance can be measured in the following manner. That is, the magnetic particles are carried by a roller (ϕ20; 600 RPM) containing a magnet. An electrode having an area of 65 millimeters (width) by 1 millimeter (length) is made to face the magnetic particles via a gap of 0.9 millimeter, to measure the dynamic resistance based on a current value flowing when a applied voltage of an upper limit level of a withstand pressure (from 400 volts in high-resistance silicon-coated carriers to several volts in iron powder carriers) is applied.

As the damping member to be used for the neutralizing electrode (the primary-transfer-nip outlet blade 4), the one made of a damping resin or damping rubber can be exemplified. The damping rubber includes isoprene rubber, butadiene rubber, chloroprene rubber, acrylonitrile-butadiene rubber, isobutylene-isoprene rubber, styrene-butadiene copolymer, styrene-isoprene copolymer, styrene-butadiene-acrylonitrile copolymer, ethylene propylene rubber, polyurethane elastomer, silicone rubber, fluoro rubber, chlorosulfonated polyethylene rubber, chlorinated polyethylene rubber, acrylic rubber, polysulfide rubber, propylene oxide rubber, ethylene-acrylic rubber, polynorbornene rubber, and other types of rubber.

It is preferred to use the damping member including a damping material. The damping material means a material that exhibits a damping operation by converting vibrational energy to thermal energy. A laminated damping steel sheet material in which plastic such as PP is sandwiched, a damping rubber, a material using short fiber/rubber composite material, an adhesive having vibration-damping properties, a damping alloy, and the like can be exemplified. Specifically, Visco Elastic Material (VEM: product name) manufactured by Sumitomo 3M Limited, which is a visco-elastic body, is suitable. The VEM has such a characteristic that when shear deformation is applied to the acrylic polymer having excellent weatherability, it converts transformability to the thermal energy to attenuate the vibration. The VEM has properties of both the rubber and clay, and when the VEM is pulled and released, it tends to return to an original shape due to the property of the rubber. At this time, the VEM gradually returns to the original shape, exhibiting the viscous resistance of the clay. When the VEM is put between an oscillating body and a solid body, the VEM returns to the original state faster than natural returning speed due to the vibration. At this time, the VEM converts the vibrational energy to the thermal energy due to the viscous resistance, to attenuate the vibration.

Exemplary embodiments of the present invention have been explained based on results of investigation performed by using a transfer bias source that performs so-called constant current control for keeping the amount of transfer current flowing from the intermediate transfer belt to the photosensitive element constant. However, similar effects have been confirmed also in an example using a transfer bias source that performs constant voltage control. Therefore, the present invention is also applicable to a system using the transfer bias source that performs constant voltage control.

As describe above, according to an aspect of the present invention, generation of dust at the time of transferring a toner image can be effectively prevented by a simple and cost-effective configuration.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier on which a toner image is formed;

a transfer belt that is an endless belt member having either one of a single-layer structure and a multilayer structure, the transfer belt forming a transfer nip by abutting against the image carrier while being supported by a plurality of supporting members to make an endless movement;

a transfer bias member that applies a transfer bias to the transfer belt, while abutting against an internal surface of the transfer belt at a position of the transfer nip; and a neutralizing member that applies a voltage of same polarity as that of a toner or an electric current of same polarity as that of the toner to the transfer belt, wherein a first end of the neutralizing member is fixed to a main unit of the image forming apparatus, and a second end of the neutralizing member makes a contact with the internal surface of the transfer belt, and at least a surface layer or a sub-layer of the neutralizing member having a contact with the transfer belt is made of a material having a volume resistivity higher than one tenth of a volume resistivity of a member forming the internal surface of the transfer belt.

2. The image forming apparatus according to claim 1, wherein the neutralizing member has friction coefficient of equal to or larger than 0.3 and equal to or smaller than 0.5 on its surface making a contact with the transfer belt.

3. The image forming apparatus according to claim 1, wherein the neutralizing member makes a contact with the transfer belt with a mean contact pressure per unit length in a width direction of the transfer belt larger than 0 gram per centimeter and equal to or smaller than 30 grams per centimeter.

4. The image forming apparatus according to claim 1, wherein a portion of the neutralizing member making a contact with the transfer belt is made of a material of an IRHD from 35 to 100.

5. The image forming apparatus according to claim 1, wherein an apparent bite amount of the neutralizing member with respect to the transfer belt is larger than 0 millimeter and equal to or smaller than 1.5 millimeters.

6. The image forming apparatus according to claim 1, further comprising a lubricant supplying unit that supplies a lubricant to a face of the neutralizing member that makes a contact with the transfer belt.

7. The image forming apparatus according to claim 1, wherein a portion of the neutralizing member making a contact with the transfer belt is made of a material 50% or more same as the material forming at least the internal surface of the transfer belt.

8. The image forming apparatus according to claim 1, wherein at least near a portion of the neutralizing member making a contact with the transfer belt has a damping structure.

9. The image forming apparatus according to claim 1, further comprising a rotating unit that temporarily rotates the transfer belt in a reverse direction as appropriate or at a predetermined interval.

10. An image forming apparatus comprising:

an image carrier on which a toner image is formed;

a transfer belt that is an endless belt member, forming a transfer nip by abutting against the image carrier while being supported by a plurality of supporting members to make an endless movement;

a transfer bias member that applies a transfer bias to the transfer belt, while abutting against an internal surface of the transfer belt at a position of the transfer nip; and a neutralizing member that applies a voltage of same polarity as that of a toner or an electric current of same polarity as that of the toner to the transfer belt, wherein a first end of the neutralizing member is fixed to a main unit of the image forming apparatus, and a second end of the neutralizing member makes a contact with the internal surface of the transfer belt, and at least a surface layer or a sub-layer of the neutralizing member having a contact with the transfer belt is made of a material having a volume resistivity higher than that of a member forming the transfer bias member.

11. The image forming apparatus according to claim 10, wherein the neutralizing member has friction coefficient of equal to or larger than 0.3 and equal to or smaller than 0.5 on its surface making a contact with the transfer belt.

12. The image forming apparatus according to claim 10, wherein the neutralizing member makes a contact with the transfer belt with a mean contact pressure per unit length in a width direction of the transfer belt larger than 0 gram per centimeter and equal to or smaller than 30 grams per centimeter.

13. The image forming apparatus according to claim 10, wherein a portion of the neutralizing member making a contact with the transfer belt is made of a material of an IRHD from 35 to 100.

14. The image forming apparatus according to claim 10, wherein an apparent bite amount of the neutralizing member with respect to the transfer belt is larger than 0 millimeter and equal to or smaller than 1.5 millimeters.

15. The image forming apparatus according to claim 10, further comprising a lubricant supplying unit that supplies a lubricant to a face of the neutralizing member that makes a contact with the transfer belt.

16. The image forming apparatus according to claim 10, wherein a portion of the neutralizing member making a contact with the transfer belt is made of a material 50% or more same as the material forming at least the internal surface of the transfer belt.

17. The image forming apparatus according to claim 10, wherein at least near a portion of the neutralizing member making a contact with the transfer belt has a damping structure.

18. The image forming apparatus according to claim 10, further comprising a rotating unit that temporarily rotates the transfer belt in a reverse direction as appropriate or at a predetermined interval.

19. An image forming apparatus comprising:

an image carrier on which a toner image is formed;

a transfer belt that is an endless belt member, forming a transfer nip by abutting against the image carrier while being supported by a plurality of supporting members to make an endless movement;

a transfer bias member that applies a transfer bias to the transfer belt, while abutting against an internal surface of the transfer belt at a position of the transfer nip; and a neutralizing member that applies a voltage of same polarity as that of a toner or an electric current of same polarity as that of the toner to the transfer belt, wherein a first end of the neutralizing member is fixed to a main unit of the image forming apparatus, and a second end of the neutralizing member makes a contact with the internal surface of the transfer belt, and at least a surface layer of a portion of the neutralizing member making a contact with the transfer belt is made of a material having a surface resistivity higher than that of a member forming the internal surface of the transfer belt.

* * * * *